US005321869A

United States Patent [19]

Kaempf

[11] Patent Number: 5,321,869

[45] Date of Patent: Jun. 21, 1994

[54] DEVICE FOR REMOVING PAINT FROM PAINTED SURFACES

[75] Inventor: Reinhold Kaempf, Hamburg, Fed. Rep. of Germany

[73] Assignee: Deutsche Lufthansa AG, Fed. Rep. of Germany

[21] Appl. No.: 862,747

[22] PCT Filed: Nov. 9, 1991

[86] PCT No.: PCT/EP91/02126

§ 371 Date: Jul. 29, 1992

§ 102(e) Date: Jul. 29, 1992

[87] PCT Pub. No.: WO92/10313

PCT Pub. Date: Jun. 25, 1992

[30] Foreign Application Priority Data

Jul. 12, 1990 [DE] Fed. Rep. of Germany ..... 4039092

[51] Int. Cl.[5] ..... A47L 11/30

[52] U.S. Cl. ..... 15/322; 15/345; 15/385; 239/251

[58] Field of Search ..... 15/321, 322, 385, 345; 239/225.1, 251

[56] References Cited

U.S. PATENT DOCUMENTS

| | | | |
|---|---|---|---|
| 968,934 | 8/1910 | Goughnour | 15/385 |
| 1,498,255 | 6/1924 | Winchester | 15/385 X |
| 2,695,773 | 11/1954 | McGrath | 239/251 X |
| 2,846,822 | 8/1958 | Steffen . | |
| 3,428,131 | 2/1969 | Winslow | 239/251 X |
| 3,441,086 | 4/1969 | Barnes | 239/251 X |
| 3,624,668 | 11/1971 | Krause . | |
| 4,524,550 | 6/1985 | Burke et al. . | |

FOREIGN PATENT DOCUMENTS

| | | |
|---|---|---|
| 2548432 | 10/1975 | Fed. Rep. of Germany . |
| 3229720 | 8/1982 | Fed. Rep. of Germany . |

*Primary Examiner*—Chris K. Moore
*Attorney, Agent, or Firm*—Diller, Ramik & Wight

[57] ABSTRACT

For removal of a painted surface (12), a rotating head (18) provided on a housing (10) is used, said rotating head (18) being provided with nozzles (19,20) which said nozzles (19,20) discharge high-energy jets (39) under high pressure towards the surface (12). The rotating head (18) is set into rotation by the recoil of the discharged high-energy jets. On the rotating head (18) an impeller (30) is secured constituting a centrifugal pump for the discharging of liquids in the housing (10).

11 Claims, 2 Drawing Sheets

DEVICE FOR REMOVING PAINT FROM PAINTED SURFACES

BACKGROUND OF THE INVENTION

In removing paint from painted surfaces one generally uses solvents that erode the paint or bring cause it to swell up. Subsequently, the paint is removed through mechanical means. The use of solvents leads to a substantial pollution of the environment. Chromate mixed with solvents is difficult to remove from the solvent. Furthermore, a considerable part of the solvents evaporate into the atmosphere.

It is known that a high-energy air jet having abrasive particles can be directed against a painted surface. The abrasive particles can be synthetic granulated material, glass spheres, nut shell fragments or $CO_2$ ice crystals. Such abrasive processes are disadvantageous, wherein not only the paint is removed but also the surface underneath the paint is damaged. In particular, when the surface consists of artificially reinforced material, the danger exists that the reinforced fibers will be exposed by the spraying of abrasive material, so that the painted surface, in which the paint is to be removed, will be seriously damaged.

Furthermore, it is known that for cutting concrete and other material and for the purpose of cleaning the facade of buildings high-energy water jets are directed at the surfaces. The process of high-energy water jets is also used for rust-removal and removing shell-lime deposits on off-shore structures, such as, for example, ships and off-shore drilling platforms.

It is an object of the invention to provide a device for the removal of paint from painted surfaces, whereby the pollution of the environment is minimized and the removal of paint from painted surfaces is realized.

In accordance to the invention, the device consists of a rotating head having at least one nozzle, wherefrom a high-energy liquid jet is discharged. The rotating head is caused to rotate by the pressure of the high-energy liquid jet (in particular, through the recoil thereof), so that a separate rotating device in the housing is not required. By the rotation of the rotating head and the nozzle provided thereon, a periodically pressurized admission of approximately 150 to 220 Hz is directed to individual positions of the surface. As a result of the increase and decrease of the pressurized admission, the cohesive force of the paint is overcome and the paint of the surface splinters off. Thereby the lacquered coating as well as the primer can be disengaged. The rotating head is located in the inner part of the housing, the opening of the housing being closed by the surface to be treated.

Thus, the housing encloses the treated area completely. It can be guided over the painted surface by hand or by a suitable guiding device, so that a progressive treatment of the larger surface is possible. Uncontrolled liquids are prevented from being spun into the surroundings by the closed housing. Furthermore, the level of noise is reduced. The liquid and the paint disengaged from the surface is discharged out of the housing by the impeller. The impeller constitutes a centrifugal pump in the inner part of the housing, whereby the pump does not impede the high-energy jet discharged from the nozzles and removes the suspension from the housing immediately after the origination of the suspension. Thereby it is guaranteed that the high-energy liquid jets are not obstructed by a liquid layer that is to be found on the surface.

In accordance to the invention, the device requires only a connection to the housing for the pressurized fluid and no additional drive or supply lead. Thereby, the device is easily guided over the surface to be worked upon.

The device is particularly suitable for the removal of paint from painted surfaces which consist of metal or plastic. Aircrafts have their paint removed and are repainted every four to six years. This removal of paint proceeds in a hangar where other maintenance or repairs to the aircraft are also carried out. The device can be employed without any impairment or danger to people who are entrusted with other duties on the aircraft, whereby the device is always effected only on that position it is applied. The spraying of liquids as well as the level of noise is avoided. The outer shell of the aircraft consists of aluminum alloy and partially of carbon fiber solid solution. Both materials can have paint removed from their surfaces with this same device.

However, in accordance to the invention, the application of the device is not restricted to the removal of paint from painted surfaces of aircrafts. It can also remove paint or an equivalent coating of any other painted surfaces. Thereby it is also possible with equivalent miniaturized developments to utilize the device for the removal of paint from fingernails.

The removal of paint is caused by a periodically pulsed pressurized admission of a high-energy liquid jet. Thereby solvent-free liquids can be used. The removal of paint is particularly successful with water. The removal of non-soluble paint particles from the water can be realized through sedimentation or other separating systems, so that no polluted water appears in nature. The paint material can, in such a case, be recycled.

The rotating impeller together with the rotating head rotating more than a thousand times per minute, centrifuges the suspension out of the housing to the discharge valve. A prerequisite for this function of the impeller is that the impeller, in particular the rotating head, is not impeded by a collection of liquids in the housing. If the paint removal device must be used in different positions, for example on a horizontal surface, vertical or diagonal surface and overhead the collection of fluids can be thereby prevented in each of these situations in that the impeller is situated at end of the rotating head facing the opening. The impeller is also effective directly in the vicinity of the treated surface on which the leading edge of the impeller's blade is guided along. Thereby, it is guaranteed that the liquid is directly caught by the impeller after impact on the surface and is radially centrifuged so that no collection of liquid can build up that impedes with the rotation of the impeller blades and the rotating head.

A preferred embodiment is described in greater detail with reference to the accompanying drawings, as follows:

DESCRIPTION OF THE PREFERRED EMBODIMENTS

Figure 1:
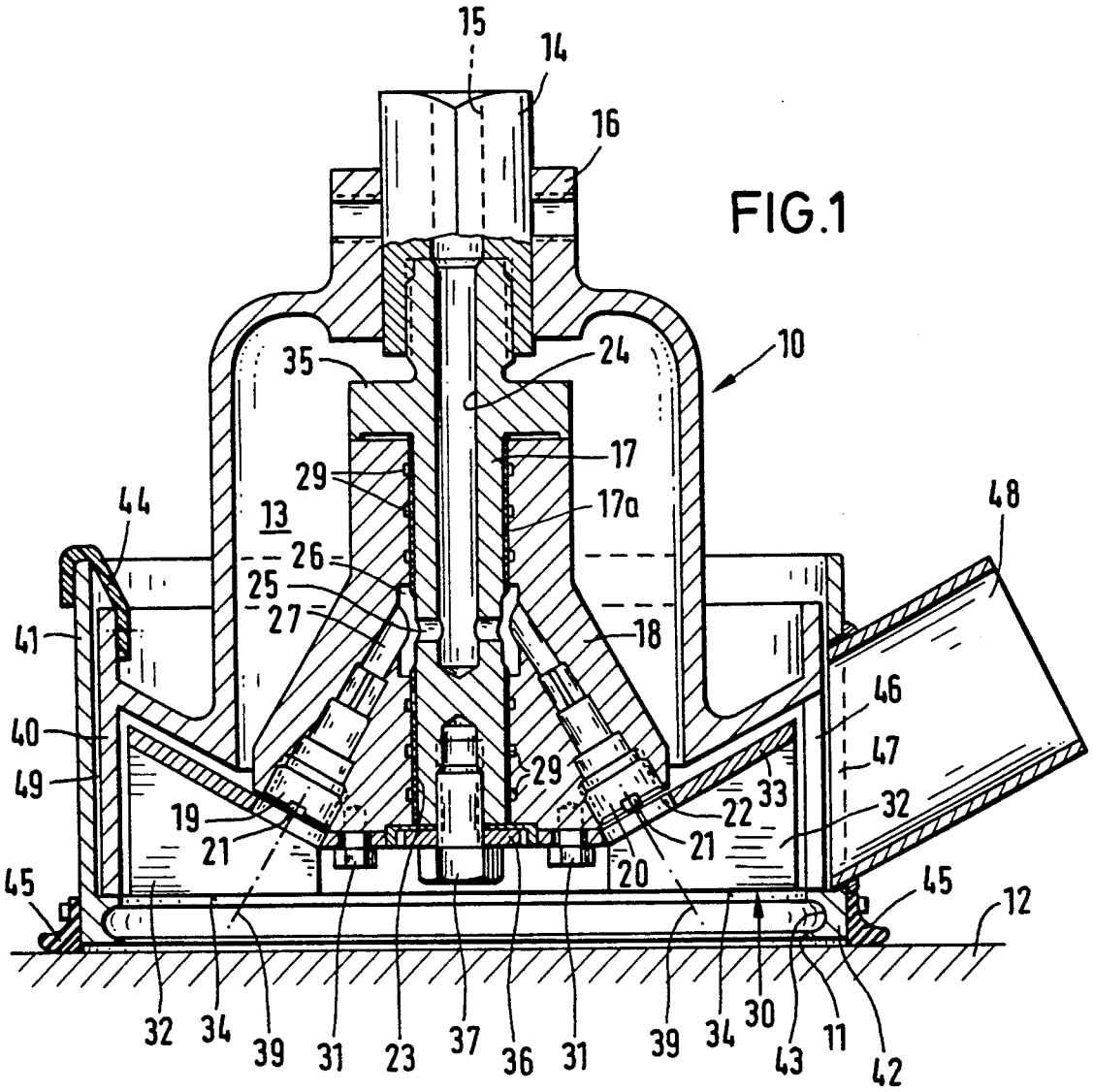
FIG. 1 is an axial view of the specific embodiment of the paint removal device and FIG. 2 is an underside view of the paint removal device
Figure 2:
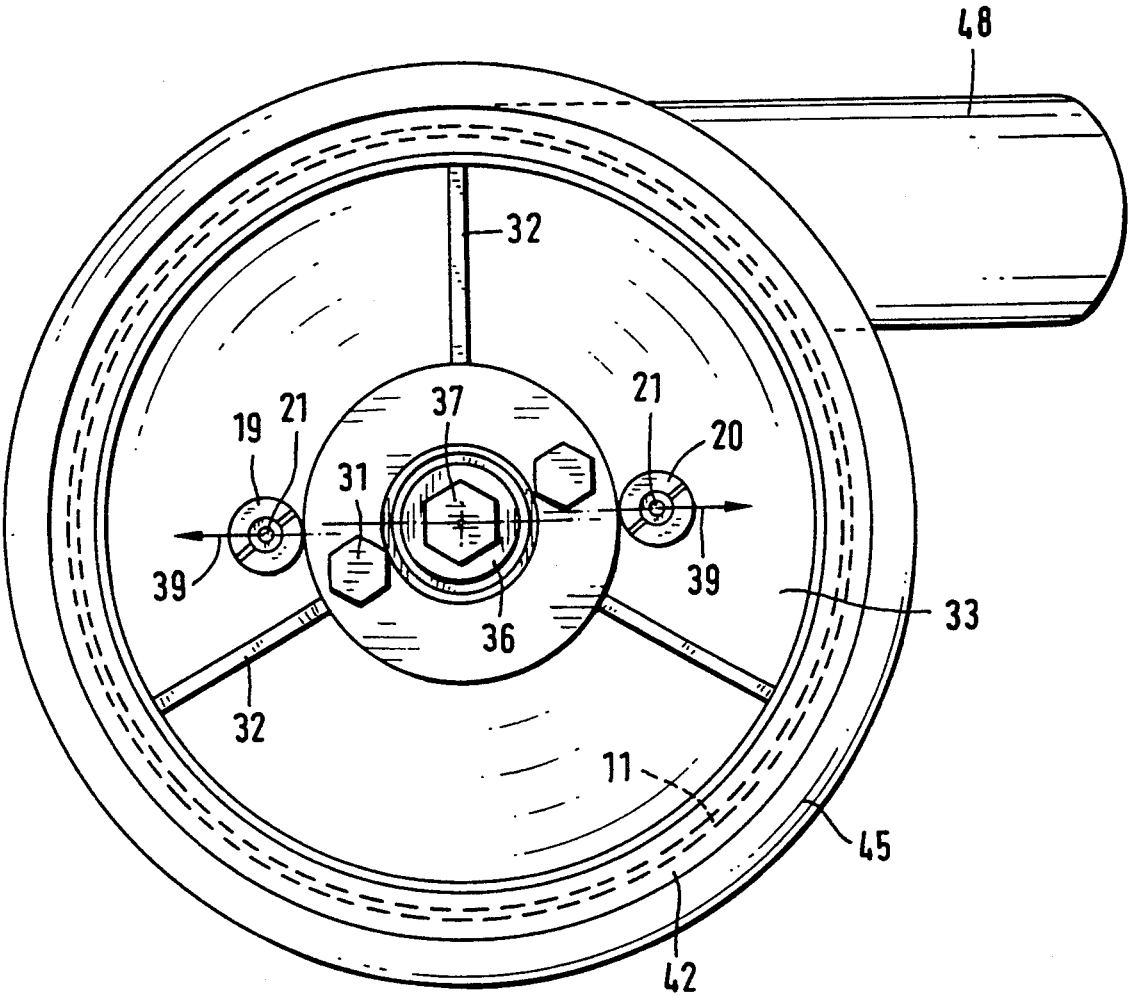

The paint removal device comprises a housing 10 in the shape of a bell and has an opening 11, whereby the rim of the opening is placed on the painted surface 12 in which the paint is to be removed. When housing 10 is placed on surface 12, then the inner change 13 of housing 10 is completely shielded from outside, however, a ventilation mechanism is provided for, which will be explained later.

At opening 11 of an averted end of housing 10 a shaft 14 is secured comprising a liquid connector 15. Shaft 14 is securely mounted to shoring 16. On shaft 14 an axle 17 is screwed in extending from shaft 14 to the vicinity of opening 11 and having a rotating head 18 pivotally mounted on axle 17. Rotating head 18 consists of two nozzles 19,20 each having a nozzle opening 21 emerging from a truncated cone shaped surface 22 which is generally perpendicular to the nozzle opening 21. The truncated cone shaped surface 22 is arranged at such an angle to surface 12, to the plane of opening 11, respectively, that the high-energy jets which are discharged out of nozzle openings 21 strike surface 12 under an angle different from 90 degrees, for example under an angle of 60 degrees. This means that the axes of the nozzles 19 and 20 form an angle of 30 degrees with axle 17.

The rotating head comprises a longitudinal bore 23 housing an axle 17. A conduit 24 inside of axle 17 is connected to liquid connector 15 and from this conduit a cross bore cylinder 25 leads to a ring groove 26 on the rotating head 18. From this ring groove 26 a bore cylinder 27 leads to the nozzles 19 and 20.

The surface of axle 17 is provided with a coating 17*a* of ceramic material, which defines sliding means for axle 17 and acts as a sealant for bore cylinder 23. Furthermore, on both sides of the ring grooves 26 leak proof grooves 29 are provided on bore cylinder 23.

At the front end of the rotating head 18 facing toward the opening 11, an impeller 30 is secured with screws 31. Impeller 30 includes a plurality of radial blades 32 secured to a packing ring 33. With respect to surface 22, packing ring 33 is developed in a truncated cone shape so that packing ring 33 has a like form and its distance from the surface 12 increases radially outwards. The front edge 34 of the impeller extends radially to the axle of rotating head 18 and in a plane which is generally parallel to the plane of opening 11.

At the back end, rotating head 18 is supported on a flange 35 of the stationary axle 17 and at the front end on a gasket 36 secured to the front end of axle 17 by a screw 37.

The nozzles 19 and 20 are arranged on rotating head 18 in such a manner that the recoil from each of the high-energy liquid jets 39 discharged out of the nozzle openings 21 turns rotating head 18. This occurs because, the high-energy jets 39, discharged out of both nozzle openings 21, do not lie in the same plane but instead in two planes displaced in respect to a plane passing through the axle of the rotating head 18 from one side to the opposite side by a slight extent. Through this slight offset of both nozzles, which is not perceptible to the naked eye, it is achieved that the high-energy liquid jets 39 discharged out of the nozzle openings 21 cause the rotating head 18 to rotate.

The blades 32 of impeller 30 extend into a radial expansion of the housing 10. This expansion is restricted by a cylindrical circumferential shell 40. Circumferential shell 40 is surrounded by a casing 41, which said casing is axially maneuverable and is restricted on the front end by a ring 42 projecting inwards. Ring 42, which defines the opening 11, contains behind the opening 11 a circumferential groove 43 for the collection of outflowing liquids on surface 12.

The rear end of casing 41 is connected to the rear end of circumferential shell 40 by several separate rubber-elastic lashings 44. The lashings 44 endeavor to shove casing 41 in the direction of surface 12. With the position of the device on surface 12, the ring 42 is the first to reach surface 12 while the circumferential shell 40 is still at a distance. Thereafter, the remaining part of housing 10 is shoved until the front end of circumferential shell 40 comes into contact with ring 42.

At the front end of casing 41 is a leak-proof bead 45 lying on surface 12 and thus plugging up the gap between the device and surface 12.

At a position on circumferential shell 40 and casing 41, openings 46,47 are provided for the placement of a tangential outlet 48 leading out of housing 10. Furthermore, a ventilation means consisting in this embodiment of a gap 49 between the circumferential shell 40 and casing 41 is provided for in housing 10. Over this circumferential gap 49, which surrounds impeller 30, the inner chamber remains in contact with the surrounding. The passage cross section of gap 49 amounts to approximately two thirds of the cross section of outlet 48. Through gap 49 outside air is drawn in and mixes with the liquid in the inner part of the device, whereby the respective mixture of liquid and air is transported out through the outlet 48. The ventilation of the inner chamber is necessary to avoid excessive vacuum build-up in housing 10 by the impeller. The vacuum produced in the housing is sufficient to draw the housing toward the surface 12 so that none or only a small contact pressure must be exerted on the housing.

The described device operates as follows: Housing 10 is placed with opening 11 on the painted surface 12, from which the paint is to be removed. From liquid connector 15, liquid under high pressure of several 100 bar, for example 400 bar, is provided. From nozzle openings 21 high-energy liquid jets 39 are discharged at high velocities. At the same time through the recoil from the discharged liquid, rotating head 18 is set into a rotating motion. The revolutions from the two nozzles to approximately 4500 to 6000 rev./min.. The high-amount energy jets 39 discharged out of rotating head 18 strike surface 12 diagonally so that they are not impeded by the reflected liquid. When housing 10 is held in a stationary position, then every position of surface 12 struck by the high-energy liquid jets is administered with a frequency of 150 to 200 Hz. Thereby the paint is disengaged from this position on surface 12.

Rotating head 18 and the thereon secured impeller 30 rotate together. The high-energy liquid jets 39 are not impeded by this impeller, because each liquid jet 39 is discharged between two blades 32. The liquid reflected from surface 12 and outflowing on this surface and the liquid in groove 43 or channel are radially centrifuged by the co-rotational impeller 30 like a centrifugal pump and propelled towards discharge outlet 48. Hereby the discharge of the liquid is supported through the intake of outside air through gap 49. The drawn-in outside air builds a stream carrying away with it all the liquid to discharge outlet 48. Since the blades of impeller 30 rotate in the direct vicinity of surface 12, the liquid is immediately discharged after the breakdown of the high-energy liquid jets so that no collection of liquid can build up in the housing which would prevent the rotation of the rotating head.

What is claimed is:

1. A device for removing paint from painted surfaces by utilizing high-energy jets comprising a housing (10) including an opening (11) adapted to be positioned against a painted surface; a rotatably mounted rotating head (18) in said housing, said rotating head (18) including at least one nozzle (19,20) facing towards said opening (11), said at least one nozzle (19,20) being connected to a pressurized liquid source, said at least one nozzle (19,20) being constructed and arranged such that the pressurized liquid rotates the rotating head (18), and said rotating head (18) carries impeller means (30) defining centrifugal pump means for centrifugally pumping the liquid toward and effecting the discharge of the liquid through an outlet (48) of said housing (10).

2. Device according to claim 1, characterized in that the impeller (30) is provided on the end of rotating head (18) facing the opening (11).

3. Device according to claim 1, characterized in that the housing (10) comprises a ventilation means having a passage, and said passage has a cross section at least half as large as the cross section of the outlet (48).

4. Device according to claim 1, characterized in that the housing (10) comprises a circumferential shell (40) and an axially maneuverable casing (41) surrounding the circumferential shell (40), which said casing (41) constitutes the opening (11); and that the casing (41) is biased in relation to the housing towards the surface (12) and moves back upon pressing the device against the surface (12).

5. Device according to claim 4, characterized in that the ventilation means consists of a gap (49) between the circumferential shell (40) and the casing (41).

6. Device according to claim 1, characterized in that the rotating head (18) includes a truncated cone shape surface (22) on which said surface (22) the impeller (30) is placed, whereby the height of the impeller (30) increases in an outwardly direction.

7. Device according to claim 1, characterized in that the blades (32) of the impeller (30) are provided on the side facing towards the opening (11) with edges (34) extending parallel to the plane of the opening (11).

8. A device for removing paint from painted surfaces by utilizing high-energy jets comprising a housing (10) including an opening (11) adapted to be positioned against a painted surface; a rotatably mounted rotating head (18) in said housing, said rotating head (18) including at least one nozzle (19,20) facing towards said opening (11), said at least one nozzle (19,20) being connected to a pressurized liquid source, said at least one nozzle (19,20) being constructed and arranged such that the pressurized liquid rotates the rotating head (18), said rotating head (18) carries impeller means (30) defining centrifugal pump means for centrifugally pumping the liquid toward and effecting the discharge of the liquid through an outlet (48) of said housing (10), said rotating head (18) having an axis of rotation, and said at least one nozzle (19,20) being inclined with respect to said rotating head axis and defining an acute angle therewith whereby liquid jets (39) discharge from said at least one nozzle (19,20) are reflected radially outwardly by an associated painted surface.

9. A device for removing paint from painted surfaces by utilizing high-energy jets comprising a housing (10) including an opening (11) adapted to be positioned against a painted surface; a rotatably mounted rotating head (18) in said housing, said rotating head (18) including at least one nozzle (19,20) facing towards said opening (11), said at least one nozzle (19,20) being connected to a pressurized liquid source, said at least one nozzle (19,20) being constructed and arranged such that the pressurized liquid rotates the rotating head (18), said rotating head (18) carries impeller means (30) defining centrifugal pump means for centrifugally pumping the liquid toward and effecting the discharge of the liquid through an outlet (48) of said housing (10), a ring (42) surrounding said opening (11), and said ring (42) having a radially inwardly opening circumferential groove (43) for collection of overflowing liquid on an associated painted surface.

10. A device for removing paint from painted surfaces by utilizing high-energy jets comprising a housing (10) including an opening (11) adapted to be positioned against a painted surface; a rotatably mounted rotating head (18) in said housing, said rotating head (18) including at least one nozzle (19,20) facing towards said opening (11), said at least one nozzle (19,20) being connected to a pressurized liquid source, said at least one nozzle (19,20) being constructed and arranged such that the pressurized liquid rotates the rotating head (18), said rotating head (18) carries impeller means (30) defining centrifugal pump means for centrifugally pumping the liquid toward and effecting the discharge of the liquid through an outlet (48) of said housing (10), and said plurality of nozzles (19,20) being so constructed and arranged that the rotating head (18) rotates at a number of revolutions in which the frequency of the pressurized discharging liquid on the same position of the painted surface is generally in the range of 150 to 200 Hz.

11. Device according to claim 1, characterized by a ring (42) surrounding the opening (11), and said ring (42) is provided with a circumferential inwardly opening groove (43) for the collection of overflowing liquid on the surface (12).

* * * * *